US008727910B2

(12) United States Patent
Nakano

(10) Patent No.: US 8,727,910 B2
(45) Date of Patent: May 20, 2014

(54) GOLF CLUB HEAD

(75) Inventor: Takashi Nakano, Hyogo (JP)

(73) Assignee: SRI Sports Limited, Kobe (JP)

( * ) Notice: Subject to any disclaimer, the term of this patent is extended or adjusted under 35 U.S.C. 154(b) by 722 days.

(21) Appl. No.: 12/489,102

(22) Filed: Jun. 22, 2009

(65) Prior Publication Data

US 2010/0022327 A1 Jan. 28, 2010

(30) Foreign Application Priority Data

Jul. 28, 2008 (JP) ..... 2008-193419

(51) Int. Cl.
*A63B 53/00* (2006.01)

(52) U.S. Cl.
USPC ..... 473/346; 473/350

(58) Field of Classification Search
USPC ..... 473/346, 350
See application file for complete search history.

(56) References Cited

U.S. PATENT DOCUMENTS

| | | | | |
|---|---|---|---|---|
| 4,214,754 | A * | 7/1980 | Zebelean | 473/346 |
| 4,432,549 | A * | 2/1984 | Zebelean | 473/346 |
| 5,067,715 | A * | 11/1991 | Schmidt et al. | 473/332 |
| 5,180,166 | A * | 1/1993 | Schmidt et al. | 473/332 |
| 5,295,689 | A * | 3/1994 | Lundberg | 473/346 |
| 5,351,958 | A * | 10/1994 | Helmstetter | 473/346 |
| 5,419,559 | A * | 5/1995 | Melanson et al. | 473/346 |
| 5,941,782 | A * | 8/1999 | Cook | 473/346 |
| 6,494,790 | B1 * | 12/2002 | Toyota et al. | 473/345 |
| 6,595,871 | B2 * | 7/2003 | Sano | 473/342 |
| 6,645,087 | B2 * | 11/2003 | Yabu | 473/342 |
| 6,783,465 | B2 * | 8/2004 | Matsunaga | 473/329 |
| D501,036 | S * | 1/2005 | Burrows | D21/752 |
| 6,852,038 | B2 * | 2/2005 | Yabu | 473/224 |
| 7,056,228 | B2 | 6/2006 | Beach et al. | |
| 7,247,103 | B2 | 7/2007 | Beach et al. | |
| 7,396,298 | B2 * | 7/2008 | Jertson et al. | 473/346 |
| 7,507,168 | B2 * | 3/2009 | Chou et al. | 473/346 |
| 7,563,177 | B2 * | 7/2009 | Jertson et al. | 473/332 |
| 7,641,568 | B2 * | 1/2010 | Hoffman et al. | 473/327 |
| 7,749,104 | B2 * | 7/2010 | Brekke et al. | 473/345 |
| 7,803,067 | B2 * | 9/2010 | Horacek et al. | 473/345 |
| 7,828,676 | B2 * | 11/2010 | Wada et al. | 473/346 |
| 8,206,242 | B2 * | 6/2012 | Jertson et al. | 473/332 |
| 2002/0072434 | A1 * | 6/2002 | Yabu | 473/345 |

(Continued)

FOREIGN PATENT DOCUMENTS

| | | | |
|---|---|---|---|
| JP | 10-33723 | A | 2/1998 |
| JP | 2002-186691 | A | 7/2002 |
| JP | 2008-011870 | A | 1/2008 |

*Primary Examiner* — Gene Kim
*Assistant Examiner* — Matthew B Stanczak
(74) *Attorney, Agent, or Firm* — Birch, Stewart, Kolasch & Birch, LLP

(57) ABSTRACT

A head 2 is hollow. The head 2 includes a face part 4, a crown part 6 and a sole part 8. Ribs 20 and 22 are provided on the inner surface of the head. The ribs 20 and 22 have a height being greater than a thickness. The ribs 20 and 22 are separated from the face part, and are separated from the crown part. An extending direction of the rib 20 is inclined with respect to a front-back direction of the head. The rib 20 has a height change part 30 formed in a face side end part of the rib 20, the height change part 30 having a height gradually lowered as approaching a rib end part. The rib 20 extends toward a heel side in the direction of a backside of the head.

17 Claims, 6 Drawing Sheets

(56) References Cited

U.S. PATENT DOCUMENTS

2003/0104878 A1* 6/2003 Yabu ..... 473/345
2005/0049081 A1* 3/2005 Boone ..... 473/346
2005/0221913 A1* 10/2005 Kusumoto ..... 473/345
2006/0172818 A1* 8/2006 Yamamoto ..... 473/345
2008/0045356 A1* 2/2008 Lin et al. ..... 473/346
2008/0070721 A1* 3/2008 Chen et al. ..... 473/346

* cited by examiner

GOLF CLUB HEAD

The present application claims priorities on Japanese Patent Application No. 2008-193419 filed on Jul. 28, 2008. The whole contents of the Japanese Patent Application are hereby incorporated by reference.

BACKGROUND OF THE INVENTION

1. Field of the Invention

The present invention relates to a hollow golf club head.

2. Description of the Related Art

A hollow golf club head has been known. The hollow structure increases a head volume and a moment of inertia. A so-called wood type golf club head is usually hollow.

The volume of a hollow part is increased and the thickness of the head is thinned with the increase in size of the head. When the hollow part is great, a hitting sound is loud. Since the vibration of the head is great when the thickness is thin, the hitting sound is loud. The head increased in size causes a loud hitting sound.

Golf club heads for obtaining a good hitting sound have been disclosed. As the inventions considering a hitting sound, Japanese Unexamined Patent Application Publication No. 2002-186691, Japanese Unexamined Patent Application Publication No. 10-33723, U.S. Pat. No. 7,056,228, and U.S. Pat. No. 7,247,103 are disclosed.

SUMMARY OF THE INVENTION

The hollow golf club head with a great volume has a drawback that the hitting sound is excessively lowered. A higher hitting sound is preferable in order to obtain a good hitting sound. When a rib provided inside the head, the hitting sound is higher. However, since the rigidity of the head is excessively increased in this case, the reduction of resilience performance and the reduction of launch angle may be caused. The reduction of the resilience performance and the reduction of the launch angle decrease a flight distance. When the rib is provided, stress concentration to the rib may occur to create crack in the rib.

The present inventor has studied about the improvement of the hitting sound while sustaining the resilience performance, and has accomplished the present invention.

It is an object of the present invention to provide a golf club head capable of improving the hitting sound while sustaining the resilience performance (coefficient of restitution).

A golf club head of the present invention includes a face part, a sole part and a crown part. The head is hollow. The head has an inner surface on which a rib (X) is provided, the rib (X) having a height and a thickness, the height being greater than the thickness. The rib (X) is separated from the face part, and is separated from the crown part. The extending direction of the rib (X) is inclined with respect to the front-back direction of the head. The rib (X) has a height change part formed in a face side end part of the rib (X), the height change part having a height gradually lowered as approaching the rib end part.

The number of the ribs (X) is preferably plural. All the ribs (X) are preferably separated from the face part. All the ribs (X) are preferably separated from the crown part. The extending directions of all the ribs (X) are preferably inclined with respect to the front-back direction of the head. All the ribs (X) preferably have the height change parts formed in the face side end parts of the ribs (X).

Preferably, a rib (X1) extending toward a heel side in the direction of the backside of the head and a rib (X2) extending toward a toe side in the direction of the backside of the head exist as the rib (X). When the number of the ribs (X1) is defined as N1 and the number of the ribs (X2) is defined as N2, N1 is preferably equal to N2. Conceptually, the rib (X) contains the rib (X1) and the rib (X2).

The rib (X1) is preferably located on the heel side of the rib (X2).

Preferably, a rib (Y) is further provided, the rib (Y) having a height being equal to or less than the thickness and lower than the maximum height of the rib (X). Preferably, the rib (Y) connects the height change part of the rib (X1) to the height change part of the rib (X2).

Preferably, the rib (Y) is separated from the face part. Preferably, the rib (Y) is separated from the crown part. Preferably, the rib (Y) is separated from a hosel part.

Preferably, the rib (Y) extends in a curved condition.

Preferably, the rib (Y) is curved so as to project toward the backside of the head.

Preferably, a rib (X1) extending toward a heel side in the direction of a backside of the head, and a rib (X2) extending toward a toe side in the direction of the backside of the head exist as the rib (X). Preferably, the rib (X1) has a height change part formed in a backside end part of the rib (X1); the height change part having a height gradually lowered as approaching the rib end part. Preferably, the rib (X2) has a height change part formed in a backside end part of the rib (X2), the height change part having a height gradually lowered as approaching the rib end part.

Preferably, an angle $\alpha$ between an extending direction Dr of the rib (X) and a front-back direction fb of the head is 10 degrees or greater and 80 degrees or less.

Preferably, a ratio [Rh/Rt] of a height Rh of the rib (X) to a thickness Rt of the rib (X) is 2 or greater and 20 or less.

Preferably, a height Rh of the rib (X) is 1 mm or greater and 30 mm or less.

Preferably, a thickness Rt of the rib (X) is 0.1 mm or greater and 5 mm or less.

Preferably, a length Lr of the rib (X) is 5 mm or greater and 150 mm or less.

Preferably, an angle $\theta$1 between a tangent line Lf in the face side end part of the rib (X) and an inner surface of the head in the end part is 10 degrees or greater and 80 degrees or less.

Preferably, an angle $\theta$2 between a tangent line Lb in the backside end part of the rib (X) and an inner surface of the head in the end part is 10 degrees or greater and 80 degrees or less.

Preferably, a thickness T1 of a head body at a region of on which the rib (X) is provided is 0.4 mm or greater and 4 mm or less.

Preferably, a thickness T2 of a head body at a region on which the rib (Y) is provided is 0.4 mm or greater and 4 mm or less.

Preferably, a volume of the head is 350 cc or greater and 460 cc or less.

Preferably, a weight of the head is 180 g or greater and 300 g or less.

DESCRIPTION OF THE PREFERRED EMBODIMENTS

Hereinafter, the present invention will be described in detail according to the preferred embodiments with appropriate references to the accompanying drawings.

Figure 1:
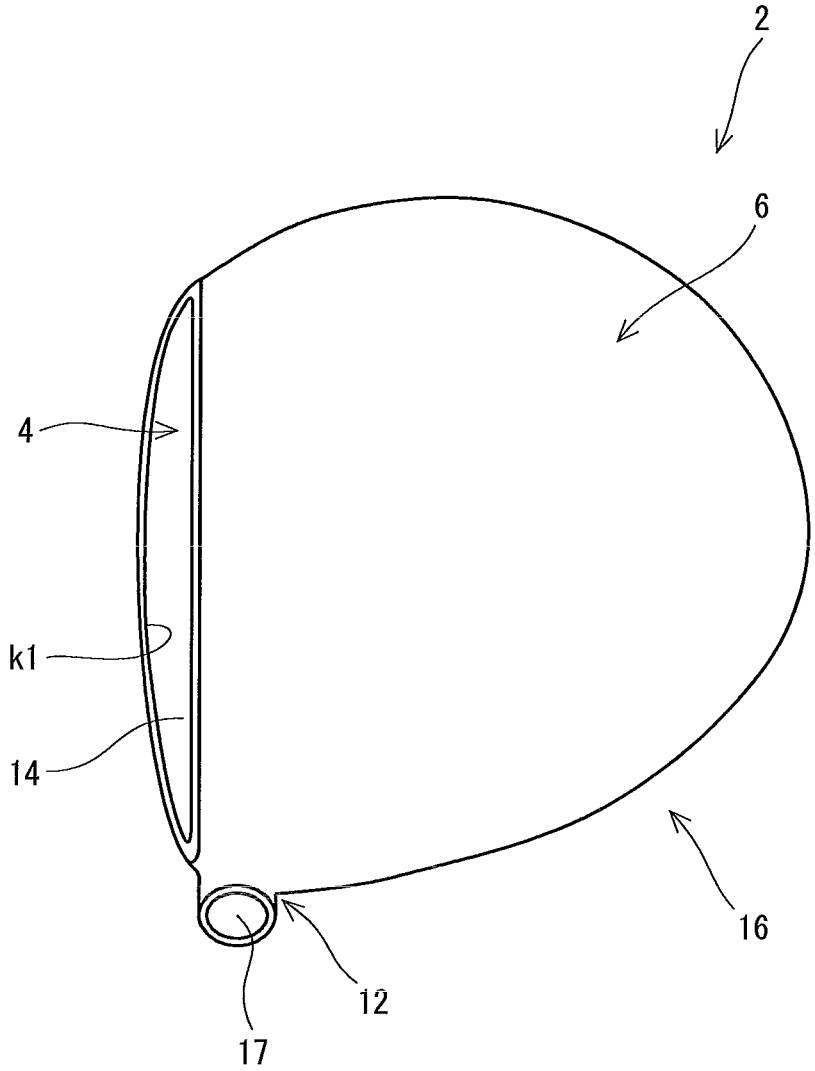
FIG. 1 is a view of a golf club head according to one embodiment of the present invention as seen from a crown side.
Figure 2:
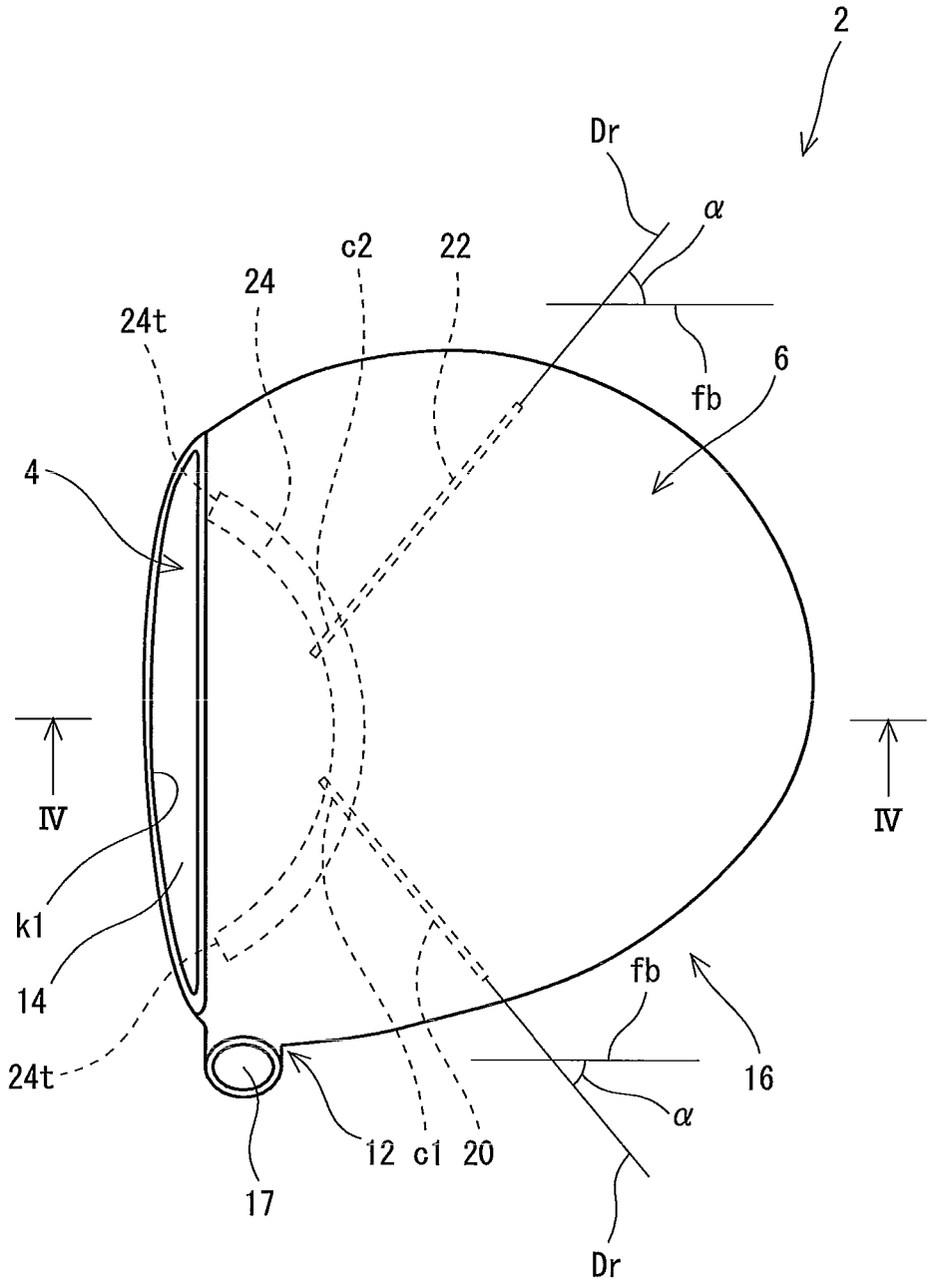
FIG. 2 is a view in which ribs existing inside the head written on FIG. 1.
Figure 3:
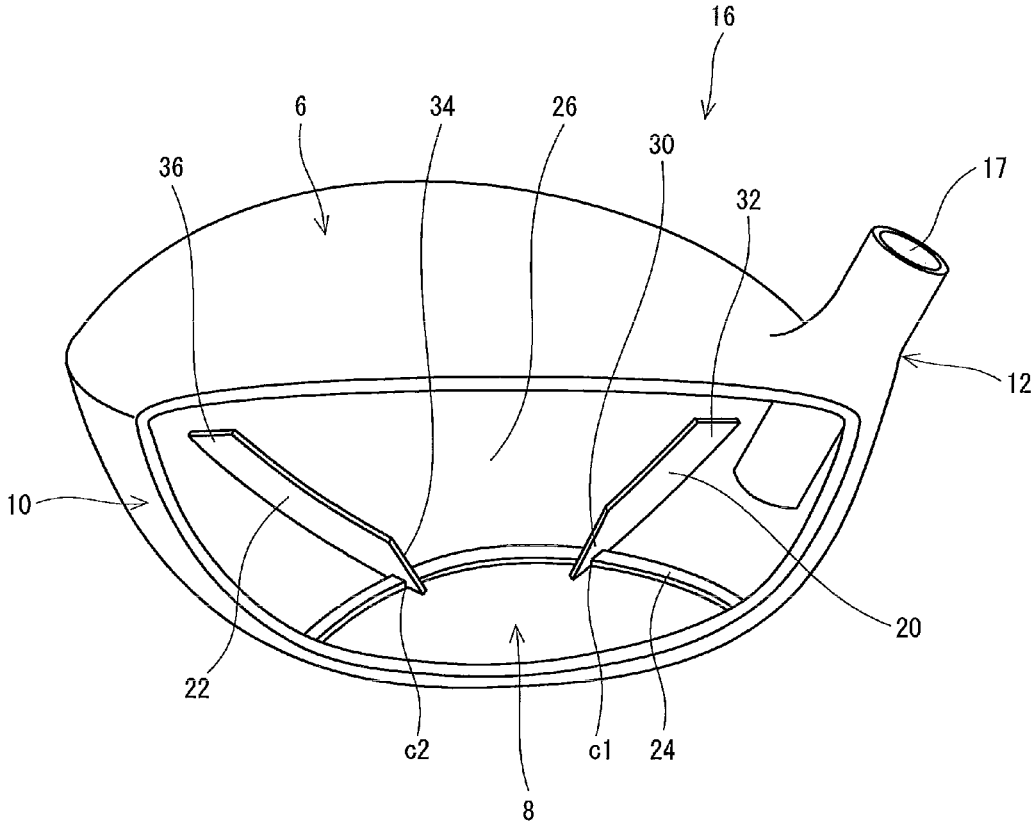
FIG. 3 is a perspective view of a head body.
Figure 4:
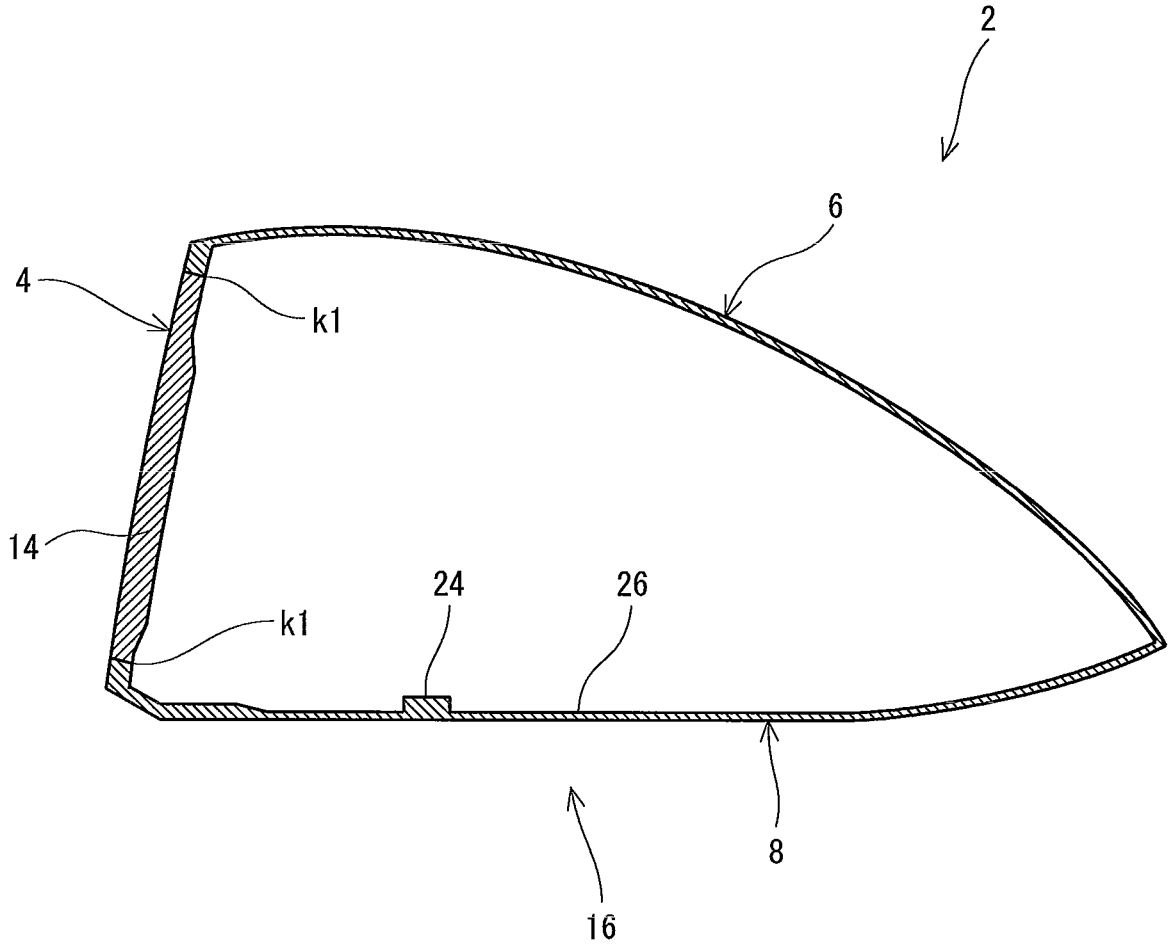
FIG. 4 is a cross sectional view taken along a line IV-IV in FIG. 2.

FIG. 1 is a view of a golf club head 2 according to one embodiment of the present invention as seen from a crown side. FIG. 2 is a view in which ribs disposed inside the head are additionally drawn in FIG. 1. In FIG. 2, the ribs, which are shown by dashed lines, are described in perspective view (sight through view). FIG. 3 is a perspective view of the head in a state where a face part to be described later is not mounted. In the perspective view of FIG. 3, the face part is opened, and the inside of the head can be seen. FIG. 4 is a cross sectional view taken along a line IV-IV in FIG. 2.

The head 2 has a face part 4, a crown part 6, a sole part 8, a side part 10, and a hosel part 12. The crown part 6 extends toward the backside of the head from the upper edge of the face part 4. The sole part 8 extends toward the backside of the head from the lower edge of the face part 4. The side part 10 extends between the crown part 6 and the sole part 8. As shown in FIG. 4, the inside of the head 2 is hollow. The head 2 is a hollow golf club head. The head 2 is a so-called wood type golf club head.

The head 2 is obtained by welding a face member 14 and a head body 16. The face member 14 constitutes a part of the face part 4. The face member 14 is a plate-shaped member. The face member 14 constitutes the central portion of the face part 4. In FIG. 4, a reference character k1 designates a boundary between the face member 14 and the body 16. The boundary k1 conforms to the profile line of the face member 14. In the boundary k1, the face member 14 and the body 16 are welded. The body 16 constitutes a part of the face part 4, the entire crown part 6, the entire sole part 8 the entire side part 10 and the entire hosel part 12. FIG. 3 is a perspective view of the body 16.

The hosel part 12 has a hole 17 to which a shaft is mounted. The shaft (not shown) is inserted into the hole 17. The hole 17 has a centeral axial line Z1 (not shown). The centeral axial line Z1 generally conforms to a shaft axial line of a golf club provided with the head 2.

In the present application, a standard perpendicular plane, a front-back direction and a toe-heel direction are defined. A standard condition denotes a state that the centeral axial line Z1 is contained in a plane P1 perpendicular to a horizontal plane H and the head is placed on the horizontal plane H at a prescribed lie angle and real loft angle. The standard perpendicular plane denotes the plane P1.

In the present application, the toe-heel direction is a direction of line of intersection between the standard perpendicular plane and the horizontal plane H.

In the present application, the front-back direction is a direction perpendicular to the toe-heel direction and parallel to the horizontal plane H.

The head 2 has an inner surface on which ribs are provided. In the present application, the ribs provided on the inner surface of the head are classified as follows and designated.

Rib (X): The rib (X) is a rib having a height Rh greater than a thickness Rt.

Rib (X1): The rib (X1), which is contained in the rib (X), extends toward a heel side in the direction of the backside of the head.

Rib (X2): The rib (X2), which is contained in the rib (X), extends toward a toe side in the direction of the backside of the head.

Rib (Y): The rib (Y) is a rib having a height Rh equal to or less than a thickness Rt and lower than the maximum height of the rib (X).

Ribs other than the rib (X) and the rib (Y) may be provided in the head of the present invention.

As shown in FIGS. 2 and 3, the head 2 has a rib 20, a rib 22 and a rib 24. The rib 20 is provided on an inner surface 26 of the sole part 8. The rib 22 is provided on the inner surface 26 of the sole part 8. The rib 24 is provided on the inner surface 26 of the sole part 8.

The rib 20 is the rib (X). The rib 20 is the rib (X1). The rib 20 is separated from the face part 4. The rib 20 is separated from the crown part 6. The rib 20 is separated from the hosel part 12. The rib 20 is provided on the sole part 8. The rib 20 is provided only on the sole part 8.

The rib 22 is the rib (X). The rib 22 is the rib (X2). The rib 22 is separated from the face part 4. The rib 22 is separated from the crown part 6. The rib 22 is separated from the hosel part 12. The rib 22 is provided on the sole part 8. The rib 22 is provided only on the sole part 8.

The rib 20 is located on the heel side of the rib 22. A distance between the rib 20 and the rib 22 in the toe-heel direction becomes greater toward the backside of the head (see FIG. 2). The arrangement can attain the improvement in a hitting sound while sustaining durability, launch angle and resilience performance at a high level.

The rib 24 is the rib (Y). The height Rh of the rib 24 is smaller than the thickness Rt of the rib 24 (see FIG. 5). The height Rh of the rib 24 is lower than the maximum height Rm of the rib (X). When the maximum value of the height Rh of the rib 20 is defined as Rm1, and the maximum value of the height Rh of the rib 22 is defined as Rm2 in this embodiment, the maximum height Rm is defined as the minimum value of the heights Rm1 and Rm2.

The rib 24 is separated from the face part 4. That is, as shown in FIG. 2, an end 24*t* of the rib 24 does not reach the face part 4. The rib 24 is separated from the crown part 6. The rib 24 is separated from the hosel part 12. The rib 24 is provided on the sole part 8. The rib 24 is provided only on the sole part 8.

The rib 24 extends in a curved condition. The rib 24 is curved so as to project toward a backside of the head.

As shown in FIGS. 2 and 3, the rib 24 and the rib 20 form an intersection part c1. The height Rh of the rib 24 is lower than the minimum height Hs of the rib 20 in the intersection part c1 (see FIG. 5).

As shown in FIGS. 2 and 3, the rib 24 and the rib 22 form an intersection part c2. The height Rh of the rib 24 is lower than the minimum height of the rib 22 in the intersection part c2.

Thus, in the head 2, the intersection part is formed by the rib (Y) and the rib (X), and the height Rh of the rib (Y) is equal to or lower than the minimum height Hs of the rib (X) in the intersection part.

An extending direction Dr of the rib (X) is inclined with respect to a front-back direction fb of the head (see FIG. 2). That is, an angle $\alpha$ between the extending direction Dr and the front-back direction fb is greater than 0 degree and less than 90 degrees. The extending direction Dr and the angle $\alpha$ are determined by a projected image x obtained by projecting the rib (X) on the horizontal plane H. In the projection of this rib (X), the head is set to the standard condition. In projection of the rib (X), the projecting direction is set to a direction perpendicular to the horizontal plane H. The angle $\alpha$ means a smaller angle of angles between the extending direction Dr and the front-back direction fb.

Figure 5:
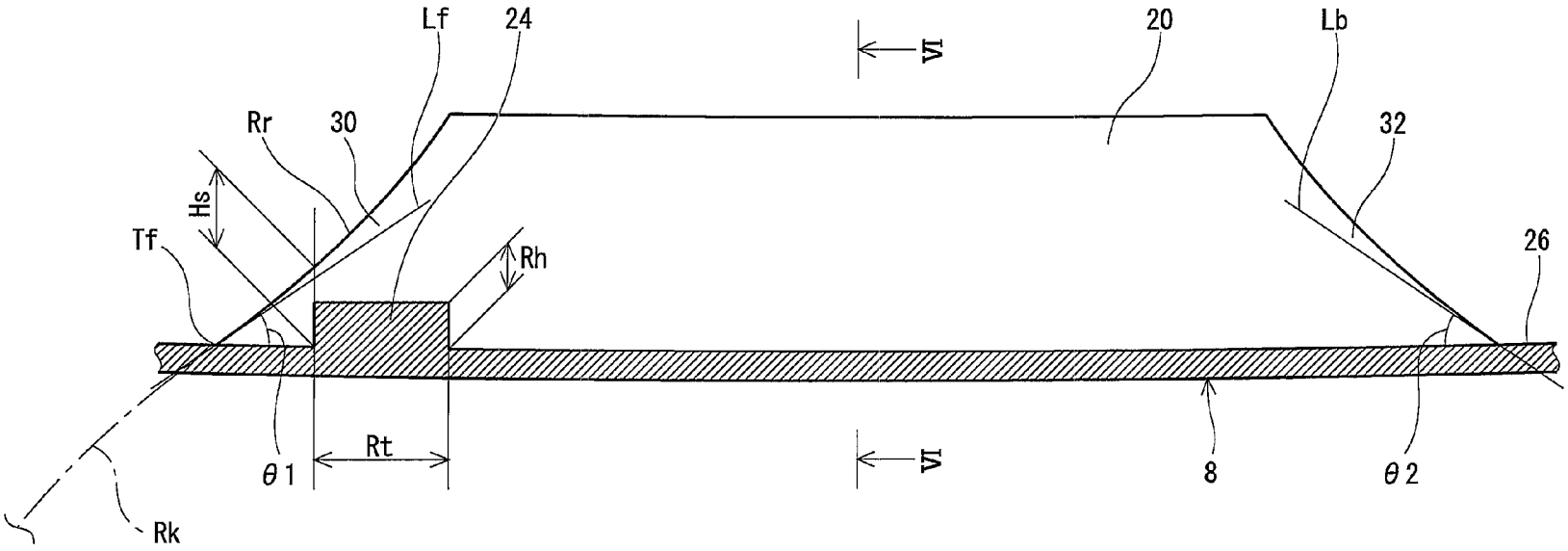
FIG. 5 is a cross sectional view taken along a rib (X)

FIG. 5 is an expanded cross sectional view along the longitudinal direction of the rib 20. Although the cross section of FIG. 5 does not cross the rib 20, the cross section is located near the rib 20. The rib 20 has a height change part 30 formed in a face side (front side) end part of the rib 20, the height change part 30 having a height gradually lowered as approaching the rib end part. The rib 20 has a height change part 32 formed in a backside end part of the rib 20, the height change part 32 having a height gradually lowered as approaching the rib end part.

The rib 22 also has the same height change part as that of the rib 20. The rib 22 has a height change part 34 formed in a face side (front side) end part of the rib 22, the height change part 34 having a height gradually lowered as approaching the rib end part. The rib 22 has a height change part 36 formed in a backside end part of the rib 22, the height change part 36 having a height gradually lowered as approaching the rib end part.

The rib 24 continuously extends between the height change part 30 and the height change part 34. The rib 24 connects the height change part 30 to the height change part 34. The rib (Y) connects the height change part 30 to the height change part 34 to improve the hitting sound while sustaining the durability, the launch angle and the resilience performance.

The head is compressed in the front-back direction by impact with a ball. The head compressed and deformed in the front-back direction is deformed so as to restore the original shape. In this restoring deformation, the head expands in the front-back direction. The restoring deformation can enhance the resilience performance (coefficient of restitution). The excessive increase in the rigidity of the head and the reduction of the resilience performance can be suppressed by inclining the extending direction Dr with respect to the front-back direction fb. That is, the compression deformation and the restoring deformation are not excessively constrained by inclining the extending direction Dr with respect to the front-back direction fb. Therefore, the reduction of the resilience performance caused by the rib is suppressed.

When the rib (X) extends in the curved condition, the extending direction Dr is a direction of a tangent line at each of points. The tangent line is a tangent line of a central line of the rib (X) in the width direction. The tangent line is drawn in the projected image x.

When the rib (X) is parallel to the front-back direction fb, a stress is apt to concentrate in the face side end part of the rib. Damage in the face side end part of the rib is apt to be caused by the stress concentration. The stress concentration to the face side end part of the rib can be alleviated by inclining the extending direction Dr with respect to the front-back direction fb.

When the rib (X) is parallel to the toe-heel direction, the vibration of the rib (X) caused by the impact of the ball is increased. The great vibration is apt to deteriorate the durability of the rib or rib base part. The rib base part means a head body immediately below the rib. The excessive vibration of the rib is suppressed by inclining the extending direction Dr with respect to the front-back direction fb.

In light of the alleviation of the stress concentration to the rib end part, and of the resilience performance, the angle $\alpha$ is preferably equal to or greater than 10 degrees, and more preferably equal to or greater than 30 degrees. In light of the durability of the rib or rib base part, the angle $\alpha$ is preferably equal to or less than 80 degrees, and more preferably equal to or less than 60 degrees.

The excessive rigidity of the face part inhibits the deformation of the face part at the time of impact. Therefore, the excessive rigidity of the face part is apt to reduce the resilience performance (coefficient of restitution). The rib (X) is separated from the face part to suppress the excessive rigidity of the face part. Therefore, the rib (X) can be separated from the face part to enhance the resilience performance.

When the crown part is compressed in the front-back direction at the time of impact, the loft angle is increased. The excessive rigidity of the crown part reduces the compression deformation of the crown part in the front-back direction at the time of impact. Therefore, the excessive rigidity of the crown part is apt to reduce the launch angle. The rib (X) is separated from the crown part to heighten the launch angle. The heightened launch angle can contribute to the increase in the flight distance.

The height change part formed in the face side end part of the rib (X) alleviates the stress concentration to the rib end part caused by the impact at the time of hitting balls. The alleviation enhances the durability of the rib. Since the height change part formed in the backside end part of the rib (X) can alleviate the stress concentration in the backside end part of the rib (X), the height change part contributes to the durability of the rib.

Figure 6:
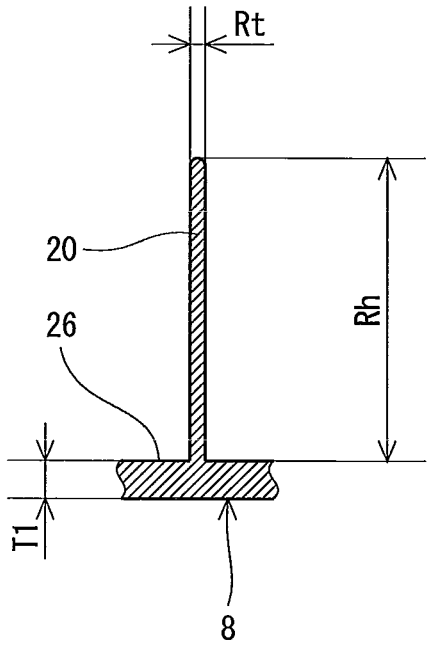
FIG. 6 is a cross sectional view taken along a line VI-VI in FIG. 5.

FIG. 6 is a cross sectional view taken along a line VI-VI in FIG. 5. In light of suppressing the excessive increase in the rigidity of the head, a ratio [Rh/Rt] of the rib (X) is preferably equal to or greater than 2, more preferably equal to or greater than 3, and still more preferably equal to or greater than 5. When the ratio [Rh/Rt] is excessively great, the vibration of the rib (X) becomes excessive, and the durability is apt to be reduced. In light of the durability, the ratio [Rh/Rt] is preferably equal to or less than 20, more preferably equal to or less than 15, and still more preferably equal to or less than 10.

In light of increasing the rigidity of the head to make the hitting sound high, the height Rh of the rib (X) is preferably equal to or greater than 1 mm, more preferably equal to or greater than 2 mm, and still more preferably equal to or greater than 3 mm. In light of the resilience performance, the height Rh of the rib (X) is preferably equal to or less than 30 mm, more preferably equal to or less than 25 mm, and still more preferably equal to or less than 20 mm.

In light of the durability of the rib or rib base part, the thickness Rt of the rib (X) is preferably equal to or greater than 0.1 mm, more preferably equal to or greater than 0.3 mm, and still more preferably equal to or greater than 0.5 mm. In light of the resilience performance, the thickness Rt of the rib (X) is preferably equal to or less than 5 mm, more preferably equal to or less than 4 mm, and still more preferably equal to or less than 3 mm.

In light of increasing the rigidity of the head to make the hitting sound high, the length Lr of the rib (X) is preferably equal to or greater than 5 mm, more preferably equal to or greater than 10 mm, and still more preferably equal to or greater than 15 mm. The excessive weight of the rib reduces the design freedom of the position of the center of gravity of the head. From this viewpoint, the length Lr is preferably equal to or less than 150 mm, more preferably equal to or less than 130 mm, and still more preferably equal to or less than 100 mm.

An angle $\theta$1 shown in FIG. 5 is an angle between a tangent line Lf in the face side end part of the rib (X) and the inner surface of the head in the end part. In light of the durability of the rib end part, the angle $\theta$1 is preferably equal to or less than 80 degrees, more preferably equal to or less than 60 degrees, and still more preferably equal to or less than 45 degrees. In light of enhancing the hitting sound improving effect by the rib (X), the angle θ1 is preferably equal to or greater than 10 degrees, and more preferably equal to or greater than 30 degrees.

An angle θ2 shown in FIG. 5 is an angle between a tangent line Lb in the backside end part of the rib (X) and the inner surface of the head in the end part. In light of the durability of the rib end part, the angle θ2 is preferably equal to or less than 80 degrees, more preferably equal to or less than 60 degrees, and still more preferably equal to or less than 45 degrees. In light of enhancing the hitting sound improving effect by the rib (X), the angle θ2 is preferably equal to or greater than 10 degrees, and more preferably equal to or greater than 30 degrees.

In light of improving the hitting sound while sustaining the durability, the launch angle and the resilience performance, the angle θ1 is preferably smaller than the angle θ2.

The angle θ1 can be determined as follows. A plane Pr is set, which passes through the face side end of the rib (X) and has a maximum overlap with the rib (X). That is, the plane Pr is selected, which passes through the face side end of the rib (X) and has a maximum cross sectional area of the rib (X). The angle θ1 is determined in a cross section Pd at the plane Pr. Since a rib profile line Rr has a portion which does not exist on the cross section Pd, the angle θ1 may not be able to be determined. In this case, the projection image of the rib to the cross section Pd is adopted as rib profile line Rr drawn on the cross section Pd. The projection is made in a direction perpendicular to the cross section Pd. In the cross section Pd, the tangent line Lf is drawn and the angle θ1 is determined. The tangent line Lf is a tangent line at a rib end point Tf in the cross section Pd. Since the point Tf is an end point, the tangent line cannot be drawn to the rib profile line Rr at the point Tf. Then, a virtual line Rk is drawn in the cross section Pd (see FIG. 5). In the cross section Pd, the virtual line Rk and the rib profile line Rr are point symmetrically related with each other. The symmetry center of the point symmetry is the rib end point Tf. The tangent line Lf of the rib end point Tf is drawn in the presence of the virtual line Rk. The angle θ1 is an angle between the tangent line Lf and a tangent line Ln of the inner surface 26 at the rib end point Tf. In the cross section Pd, a cross section line Lj of an inner surface 29 may be disconnected at the rib end point Tf. In this case, the tangent line Ln cannot be drawn. In this case, in order to be able to draw the tangent line Ln, an extension line Le of the cross section of the rib is drawn. The extension line Le is symmetrical with respect to a point with the cross section line Lj, and the symmetry center of the point symmetry is the rib end point Tf. When a plurality of planes Pr may exist, the plane Pr is selected so as that the angle θ1 becomes the smallest. The angle θ2 is determined in the same manner as in the angle θ1. When the rib end point Tf exists on the other rib, the inner surface 26 is replaced by the surface of the other rib. FIG. 5 does not show the cross section Pd. However, in light of facilitating the understanding, the virtual line Rk or the like is drawn in FIG. 5.

The number of the ribs (X) may be one or plural. In the head 2, the number of the ribs (X) is two. That is, in the head 2, the number of the ribs (X) is plural.

When the number of the ribs (X) is plural, it is preferable that all the ribs (X) are separated from the face part, and are separated from the crown part. When the number of the ribs (X) is plural, it is preferable that the extending directions of all the ribs (X) are inclined with respect to the front-back direction of the head. When the number of the ribs (X) is plural, it is preferable that all the ribs (X) have the height change parts formed in the face side end parts of the ribs (X). When the number of the ribs (X) is plural, the preferred modes of the ribs (X) are preferably realized in all the ribs (X).

It is preferable that, as the rib (X), the rib (X1) (rib 20) extending toward the heel side in the direction of the backside of the head and the rib (X2) (rib 22) extending toward the toe side in the direction of the backside of the head exist as seen in the head 2. When the number of the ribs (X1) is defined as N1 and the number of the ribs (X2) is defined as N2, N1 is preferably equal to N2. In the head 2, N1 is 1 and N2 is also 1. In the head 2, N1 is equal to N2.

N1 may be equal to or greater than 2. In light of suppressing the excessive rigidity of the head to increase the resilience performance, N1 is more preferably 1. N2 may be equal to or greater than 2. In light of suppressing the excessive rigidity of the head to increase the resilience performance, N2 is more preferably 1.

In light of attaining the improvement of the hitting sound while sustaining the durability, the launch angle and the resilience performance at a high level, N1 is preferably equal to N2. The rib (X1) is preferably disposed on the heel side of the rib (X2). In the arrangement, a distance between the rib (X1) and the rib (X2) in the toe-heel direction becomes greater toward the backside of the head. The arrangement can attain the improvement in the hitting sound while sustaining the durability, the launch angle and the resilience at a high level.

In light of suppressing the excessive rigidity of the head to increase the resilience performance, the number of the rib (Y) (the rib 24) which connects the ribs (X) with each other is preferably 1.

In light of the strength of the head, a thickness T1 of the head of at a region on which the rib (X) is provided is preferably equal to or greater than 0.4 mm, more preferably equal to or greater than 0.5 mm, and still more preferably equal to or greater than 0.6 mm. When the head body is too heavy, the design freedom of the head is reduced, and the design freedom of the rib is also reduced. From this viewpoint, the thickness T1 is preferably equal to or less than 4 mm or less, and more preferably equal to or less than 3 mm.

In light of the strength of the head, a thickness T2 of the head body at a region on which the rib (Y) is provided is preferably equal to or greater than 0.4 mm, more preferably equal to or greater than 0.5 mm, and still more preferably equal to or greater than 0.6 mm. When the head body is too heavy, the design freedom of the head is reduced, and the design freedom of the rib is also reduced. From this viewpoint, the thickness T2 is preferably equal to or less than 4 mm, and more preferably equal to or less than 3 mm.

When the thickness of the head is too thick, the rigidity of the head increases excessively, and the resilience performance (coefficient of restitution) is apt to be deteriorated. From this viewpoint, the volume of the head is preferably equal to or greater than 350 cc, more preferably equal to or greater than 380 cc, and still more preferably equal to or greater than 400 cc. In light of being compliant with the Golf Rules, the volume of the head is preferably equal to or less than 460 cc.

In light of a great moment of inertia enhancing the directionality of the ball, the weight of the head is preferably equal to or greater than 180 g, more preferably equal to or greater than 190 g, and still more preferably equal to or greater than 195 g. In light of obtaining the golf club which having an optimum club balance and being easily swung, the weight of the head is preferably equal to or less than 300 g, and more preferably equal to or less than 250 g.

The material for the head is not limited. As the material for the head, metal and CFRP (Carbon Fiber Reinforced Plastic) or the like are exemplified. As the metal used for the head, one or more kinds of metals selected from pure titanium, a titanium alloy, stainless steel, maraging steel, an aluminium alloy, a magnesium alloy and a tungsten-nickel alloy are exemplified. SUS630 and SUS304 are exemplified as stainless steel. As the specific example of stainless steel, CUSTOM450 (manufactured by CARPENTER TECHNOLOGY CORPORATION) is exemplified. As the titanium alloy, 6-4 titanium (Ti-6A1-4V) and Ti-15V-3Cr-3Sn-3A1 or the like are exemplified.

A method for manufacturing the head is not particularly limited. Usually, a hollow head is manufactured by bonding two or more members. A method for manufacturing the members constituting the head is not limited. As the method, casting, forging and press forming are exemplified.

Examples of the structures of the heads include a two-piece structure in which two members integrally formed respectively are bonded, a three-piece structure in which three members integrally formed respectively are bonded, and a four-piece structure in which four members integrally formed respectively are bonded.

The following items are exemplified as the method for manufacturing the head.

(1) A head obtained by bonding a head body made of stainless steel and formed by casting, and a face member made of a titanium alloy by brazing.
(2) A head obtained by bonding a head body made of stainless steel and formed by casting, a face member made of a titanium alloy, and a crown member made of a titanium alloy by brazing.
(3) A head obtained by bonding a head body made of stainless steel and formed by casting, and a face member made of maraging steel by welding.
(4) A head obtained by bonding a head body made of stainless steel and formed by casting, and a crown member made of a carbon fiber reinforced resin by an adhesive.
(5) A head obtained by bonding a head body made of stainless steel and formed by casting, and a crown member made of a magnesium alloy by an adhesive.
(6) A head obtained by bonding a head body made of a titanium alloy and formed by casting, and a face member made of a titanium alloy by welding.
(7) A head obtained by bonding a head body made of a titanium alloy and formed by casting, a face member made of a titanium alloy, and a crown member made of a titanium alloy by welding.
(8) A head obtained by welding a head body made of a titanium alloy and formed by casting and a face member made of a titanium alloy, and further bonding the head body and a crown member made of a carbon fiber reinforced resin by an adhesive.
(9) A head obtained by welding a head body made of a titanium alloy and formed by casting and a face member made of a titanium alloy, and further bonding the head body and a crown member made of a magnesium alloy by an adhesive.
(10) A head obtained by bonding a head body made of a titanium alloy and formed by casting, and a face member made of a magnesium alloy by an adhesive.
(11) A head obtained by bonding a head body made of a titanium alloy and formed by casting, and a crown member made of a carbon fiber reinforced resin by an adhesive.

Of these, the heads entirely made of the titanium alloy are preferable, and the above item (6) is particularly preferable. When the head is entirely made of a titanium alloy having a low specific gravity, a surplus weight for forming the rib is easily secured, and the design freedom of the rib is high.

A plate-shaped face member and a cup-shaped face member are exemplified as the form of the face member. The face member 14 of the golf club 2 has a plate shape. In light of the strength, a method for manufacturing the face member is preferably forging or press forming.

EXAMPLES

Hereinafter, the effects of the present invention will be clarified by Examples. However, the present invention should not be interpreted in a limited way based on the description of Examples.

Example 1

A head having the same structure as that of the above-mentioned head 2 was produced. A head body was obtained by casting a titanium alloy (Ti-6A1-4V). A face member was obtained by forging a titanium alloy (Ti-15V-3Cr-3Sn-3A1). The head body and the face member were welded, and the outer surface of the head was ground to obtain the head. An angle $\alpha$ of a rib (X) of a toe side was set equal to an angle $\alpha$ of a rib (X) of a heel side. The angle $\alpha$ was set to 45 degrees. An angle $\theta$1 of the rib (X) of the toe side was set equal to an angle $\theta$1 of the rib (X) of the heel side. The angle $\theta$1 was set to 30 degrees. The volume of the head was 450 cc. The weight of the head was 195 g. The grinding amount of the head was adjusted so that the weight of the head was set to 195 g. A projected area of the head was 126 $cm^2$. The projected area of the head is an area when projecting the head of the standard condition on the horizontal plane H. The projection is made in a direction perpendicular to the horizontal plane H.

A shaft and grip were mounted to the head to obtain a golf club according to Example 1. The specifications of Example 1 are shown in the following Table 1. The evaluation results of Example 1 are shown in the following Table 2. The meanings of the reference characters shown in Table 1 are the same as those of the above-mentioned numerals.

Example 3

A head and a golf club according to Example 3 were obtained in the same manner as in Example 1 except that a rib (Y) (the above-mentioned rib 24) was not provided. The specifications and evaluation result of Example 3 are shown in the following Table 1 and Table 2.

Example 2

A head and a golf club according to Example 2 were obtained in the same manner as in Example 3 except that the angle $\theta$1 was set to 90 degrees. The specifications and evaluation results of Example 2 are shown in the following Table 1 and Table 2.

Example 4

A head and a golf club according to Example 4 were obtained in the same manner as in Example 1 except that the angle $\theta$1 was set to 90 degrees. The specifications and evaluation results of Example 4 are shown in the following Table 1 and Table 2.

Comparative Example 1

A head and a golf club according to Comparative Example 1 were obtained in the same manner as in Example 1 except that the rib (Y) (the above-mentioned rib 24) was not provided; the angle α was set to 90 degrees; and the angle θ1 was set to 90 degrees. The specifications and evaluation results of Comparative Example 1 are shown in the following Table 1 and Table 2.

Comparative Example 2

A head and a golf club according to Comparative Example 2 were obtained in the same manner as in Comparative Example 1 except that the angle α was set to 0 degree. The specifications and evaluation results of Comparative Example 2 are shown in the following Table 1 and Table 2.

Comparative Example 3

A head and a golf club according to Comparative Example 3 were obtained in the same manner as in Example 1 except that ribs (X) (the above-mentioned ribs 20 and 22) were not provided and the rib (Y) (the above-mentioned rib 24) was not provided. The specifications and evaluation results of Comparative Example 3 are shown in the following Table 1 and Table 2.

[Durability Test]

The golf club of each of examples was mounted to a swing robot and made to hit golf balls at a head speed of 50 m/s. The hitting point was set to a sweet spot position. The head was visually observed per 500 hits. When a damage of the head was visually discovered, the test was finished at the time. The head with no damage visually discovered after 5000 hits was cut, and the existence of internal damage of the head was observed. The result is shown in the following Table 2. The durability test was not performed in Comparative Example 3.

[Flight Distance]

Each of five golfers hit 10 golf balls with each of the golf clubs. Fifty flight distance data in total were averaged. As the ball, "XXIO XD" (trade name) manufactured by SRI Sports Limited was used. The average value was expressed in index setting Example 1 as 100. The index of the flight distance is shown in the following Table 2. The greater the index is, the greater the flight distance is.

[Real Hitting Feeling]

Each of ten golfers hit 10 golf balls with each of the golf clubs, and the hitting sound of each of the golf clubs was evaluated. The evaluation was performed with Example 1 defined as the standard. Which category the hitting sound of each of the golf clubs fall under was evaluated. The number of the golfers evaluating in each of the items (a), (b) and (c) is shown in the following Table 2.

(a) A hitting sound is higher and better than that of Example 1.

(b) A hitting sound is equivalent to that of Example 1.

(c) A hitting sound is lower and poorer than that of Example 1.

TABLE 1

Specifications of Examples and Comparative Examples

| | Example 1 | Example 3 | Example 4 | Example 2 | Comparative Example 1 | Comparative Example 2 | Comparative Example 3 |
|---|---|---|---|---|---|---|---|
| α (degree) | 45 | 45 | 45 | 45 | 90 | 0 | — |
| θ 1 (degree) | 30 | 30 | 90 | 90 | 90 | 90 | — |
| Number of ribs (X) | 2 | 2 | 2 | 2 | 2 | 2 | None |
| Number of ribs (Y) | 1 | None | 1 | None | None | None | None |
| Height Rh of rib (X) (mm) | 7 | 7 | 7 | 7 | 7 | 7 | — |
| Thickness Rt of rib (X) (mm) | 0.7 | 0.7 | 0.7 | 0.7 | 0.7 | 0.7 | — |
| [Rh/Rt] of rib (X) | 10 | 10 | 10 | 10 | 10 | 10 | — |
| Length Lr of rib (X) (mm) | 50 | 50 | 50 | 50 | 50 | 50 | — |
| Height Rh of rib (Y) (mm) | 0.7 | — | 0.7 | — | — | — | — |
| Thickness Rt of rib (Y) (mm) | 4 | — | 4 | — | — | — | — |

TABLE 2

Evaluation results of Examples and Comparative Examples

| | Example 1 | Example 3 | Example 4 | Example 2 | Comparative Example 1 | Comparative Example 2 | Comparative Example 3 |
|---|---|---|---|---|---|---|---|
| Real hitting feeling | — | (a) 1<br>(b) 9<br>(c) 0 | (a) 0<br>(b) 10<br>(c) 0 | (a) 2<br>(b) 8<br>(c) 0 | (a) 3<br>(b) 7<br>(c) 0 | (a) 0<br>(b) 8<br>(c) 2 | (a) 0<br>(b) 0<br>(c) 10 |
| Flight distance (Index) | 100 | 100 | 100 | 100 | 101 | 99 | 100 |
| Durability | After 5000 hits, there was no internal damage. | After 5000 hits, there was no internal damage. | After 5000 hits, there was no internal damage. | After 5000 hits, there was no appearance damage. Internal damage was caused in a rib region. | Appearance damage was caused after 2000 hits. Crack extending from a rib to the outer surface of a sole was created. | Appearance damage was generated after 4500 hits. Crack extending from a rib to the outer surface of a sole was created. | (No test) |

Comparative Example 1 had the worst durability, and then Comparative Example 2 had second worst durability. Since Comparative Example 2 had low resilience performance, Comparative Example 2 had a short flight distance. Comparative Example 3 had the worst hitting sound, and then Comparative Example 2 had second worst hitting sound.

As shown in Table 2, Examples have higher evaluation than those of Comparative Examples. Advantages of the present invention are clearly indicated by these results of evaluation.

The present invention is applicable to all types of golf clubs such as wood type golf clubs and utility type heads (hybrid type heads) or the like.

The description hereinabove is merely for an illustrative example, and various modifications can be made in the scope not to depart from the principles of the present invention.

What is claimed is:

1. A golf club head comprising: a face part; a sole part; and a crown part, wherein the head is hollow;

the head has an inner surface on which a rib (X1) and a rib (X2) are provided, the rib (X1) and the rib (X2) having a height greater than a thickness;

the rib (X1) and the rib (X2) are separated from the face part and separated from the crown part;

extending directions of the rib (X1) and the rib (X2) are inclined with respect to a front-back direction of the head in a projected image obtained by projecting the head setting to the standard condition on a horizontal plane H;

the rib (X1) extends toward a heel side in the direction of a backside of the head, and the rib (X2) extends toward a toe side in the direction of the backside of the head;

the rib (X1) and the rib (X2) have a height change part formed in a face side end part of the ribs, the height change parts having a height gradually lowered as approaching rib end parts;

a ratio [Rh/Rt] of a height Rh of the rib (X1) to a thickness Rt of the rib (X1) is 2 or greater and 20 or less, and a ratio [Rh/Rt] of a height Rh of the rib (X2) to a thickness Rt of the rib (X2) is 2 or greater and 20 or less; and a rib (Y) having a height equal to or less than a thickness and lower than the maximum height of the rib (X1) and the rib (Y) connects the height change part of the rib (X1) to the height change part of the rib (X2).

2. The golf club head according to claim 1, wherein the rib (X1) is located on the heel side of the rib (X2).

3. The golf club head according to claim 1, wherein the rib (Y) is separated from the face part;

the rib (Y) is separated from the crown part; and the rib (Y) is separated from a hosel part.

4. The golf club head according to claim 1, wherein the rib (Y) extends in a curved condition.

5. The golf club head according to claim 4, wherein the rib (Y) is curved so as to project toward the backside of the head.

6. The golf club head according to claim 1, wherein the rib (X1) has a height change part formed in a backside end part of the rib (X1), the height change part having a height gradually lowered as approaching the rib end part; and the rib (X2) has a height change part formed in a backside end part of the rib (X2), the height change part having a height gradually lowered as approaching the rib end part.

7. The golf club head according to claim 1, wherein an angle α between an extending direction Dr of the rib (X1) and the rib (X2) and a front-back direction fb of the head is 10 degrees or greater and 80 degrees or less.

8. The golf club head according to claim 1, wherein a height Rh of the rib (X1) and the rib (X2) is 1 mm or greater and 30 mm or less.

9. The golf club head according to claim 1, wherein a thickness Rt of the rib (X1) and the rib (X2) is 0.1 mm or greater and 5 mm or less.

10. The golf club head according to claim 1, wherein a length Lr of the rib (X1) and the rib (X2) is 5 mm or greater and 150 mm or less.

11. The golf club head according to claim 1, wherein an angle θ1 between a tangent line Lf in the face side end part of the rib (X1) and the rib (X2) and an inner surface of the head in the end part is 10 degrees or greater and 80 degrees or less.

12. The golf club head according to claim 1, wherein an angle θ2 between a tangent line Lb in the backside end part of the rib (X1) and the rib (X2) and an inner surface of the head in the end part is 10 degrees or greater and 80 degrees or less.

13. The golf club head according to claim 1, wherein a thickness T1 of a head body at a region of on which the rib (X1) and the rib (X2) are provided is 0.4 mm or greater and 4 mm or less.

14. The golf club head according to claim 1, wherein a thickness T2 of a head body at a region on which the rib (Y) is provided is 0.4 mm or greater and 4 mm or less.

15. The golf club head according to claim 1, wherein a volume of the head is 350 cc or greater and 460 cc or less.

16. The golf club head according to claim 1, wherein a weight of the head is 180 g or greater and 300 g or less.

17. The golf club head according to claim 4, wherein the dimension of the height change parts of the rib (X1) and the rib (X2) along the extending direction of the rib (X1) and the rib (X2) is greater than the dimension of the rib (Y) along the extending direction of the rib (X1) and the rib (X2).

* * * * *